US007776129B2

(12) United States Patent
Curlook et al.

(10) Patent No.: US 7,776,129 B2
(45) Date of Patent: Aug. 17, 2010

(54) APPARATUS AND PROCESS FOR MAKING HIGH PURITY NICKEL

(75) Inventors: Walter Curlook, Toronto (CA); Dmitri Terekhov, Newmarket (CA); Sergiy Kovtun, Missisauga (CA); Olujide Babatunde Olurin, Richmond Hill (CA); Nanthakumar Victor Emmanuel, Toronto (CA)

(73) Assignee: Chemical Vapour Metal Refining Inc., Ontario (CA)

( * ) Notice: Subject to any disclaimer, the term of this patent is extended or adjusted under 35 U.S.C. 154(b) by 354 days.

(21) Appl. No.: 11/790,171

(22) Filed: Apr. 24, 2007

(65) Prior Publication Data

US 2008/0267810 A1 Oct. 30, 2008

(51) Int. Cl.
*C22B 9/14* (2006.01)

(52) U.S. Cl. ..... 75/343; 148/675; 423/561.1

(58) Field of Classification Search ..... None
See application file for complete search history.

(56) References Cited

U.S. PATENT DOCUMENTS

| | | | | |
|---|---|---|---|---|
| 2,548,728 | A | 4/1951 | Kincaid et al. | |
| 2,616,781 | A | 11/1952 | Forward | |
| 2,944,883 | A | 7/1960 | Queneau et al. | |
| 3,256,060 | A | 6/1966 | Globus | |
| 4,187,281 | A | 2/1980 | Stauter | |
| 4,317,748 | A * | 3/1982 | Torok et al. | 502/337 |
| 5,081,083 | A * | 1/1992 | Wright | 502/50 |
| 5,439,859 | A * | 8/1995 | Durante et al. | 502/66 |
| 6,261,340 | B1 | 7/2001 | Edlinger | |
| 7,387,767 | B2 * | 6/2008 | Campbell et al. | 423/141 |
| 2004/0034053 | A1 | 2/2004 | Stiles | |
| 2007/0032372 | A1 | 2/2007 | Dufresne et al. | |

FOREIGN PATENT DOCUMENTS

| | | | |
|---|---|---|---|
| CA | 2525466 | A1 | 5/2007 |
| GB | 646488 | A | 11/1950 |
| GB | 769099 | A | 2/1957 |
| GB | 782242 | A | 9/1957 |
| GB | 855544 | A | 12/1960 |
| GB | 856425 | A | 12/1960 |
| GB | 863766 | A | 3/1961 |
| GB | 915188 | | 1/1963 |
| GB | 915188 | A | 1/1963 |
| GB | 1009590 | A | 11/1965 |
| GB | 1067638 | A | 5/1967 |
| GB | 1169816 | A | 11/1969 |
| GB | 1282204 | A | 7/1972 |
| GB | 1362683 | A | 8/1974 |
| GB | 2399815 | A | 9/2004 |
| SU | 1521279 | A3 | 9/1984 |

* cited by examiner

*Primary Examiner*—George Wyszomierski
(74) *Attorney, Agent, or Firm*—Jeffrey S. Melcher; Manelli Denison & Selter PLLC

(57) ABSTRACT

An improved method of reducing a mixed metal oxide composition comprising oxides of nickel, cobalt, copper and iron in a hydrogen atmosphere to produce a mixture of the respective metals, the improvement wherein the atmosphere further comprises water vapour at a concentration, temperature and time to effect selective reduction of the oxides of nickel cobalt and copper relative to the iron oxide to produce the metallic mixture having a reduced ratio of metallic iron relative to metallic nickel, cobalt and copper.

8 Claims, 4 Drawing Sheets

APPARATUS AND PROCESS FOR MAKING HIGH PURITY NICKEL

FIELD OF THE INVENTION

This invention relates to processes for the production of high purity nickel via carbonylation of impure nickel with carbon monoxide and subsequent decomposition to said high purity nickel; to processes of making said impure nickel, particularly, from compositions comprising mixed metal oxides; and to apparatus of use in said processes.

BACKGROUND OF THE INVENTION

Nickel carbonyl, $Ni(CO)_4$, was first produced by the reaction of metallic nickel with carbon monoxide by Mond in the early part of the $19^{th}$ century. Today, one of the major industrial processes for making metallic nickel is based on the production of $Ni(CO)_4$ and subsequent thermal decomposition thereof to Ni and CO. One known commercial process operates at about 180° C. and a CO pressure of about 70 atm. It is known that the CO pressure may be reduced when the reactant nickel is catalytically activated.

Activation of the metal has been observed in the presence of mercury (1,2), sulphur in the form of $H_2S$ (3,4), hydrogen (5,6) or carbon (7). It has been suggested that the high initial rate of formation of $Ni(CO)_4$ and the subsequent decline to a steady state value is the result of a rapid decrease in the number of activated reaction sites which are produced upon heat treatment of the sample (6,8,9). A study of surface changes during carbonyl synthesis suggests that the maximum rate is associated with fundamental changes in the defect structure. All of the above methods use catalytic activation of nickel in the presence of CO.

Canadian Patent No. 822,016—The International Nickel Company of Canada, published Sep. 2, 1969, discloses a high pressure carbonylation process for particular use with smelter nickel intermediates high in copper and iron.

Methods of reducing mixed metal oxide compositions comprising oxides of nickel, cobalt, copper and iron with hydrogen to produce the respective metals for subsequent nickel carbonylation in the presence of $H_2S$ and subsequent decomposition of the nickel carbonyl to metallic nickel in powder or substrate form are known.

However, there remains a need for an improved process of preparing high purity nickel, particularly, nickel powder having acceptable levels of sulphur and metallic impurities, e.g. Co, Cu and Fe.

PUBLICATIONS

1. Morton J. R., Preston K. F. *J. Chem. Phys.,* 81, 56, (1984).
2. Morton J. R., Preston K. F. *Inorg. Chem.,* 24, 3317, (1985).
3. Mercer D. L.; Inco Ltd. (Can. 1038169 [1975/78]).
4. Schafer H. Z. *Anorg. Allg. Chem.* 493, 17 (1982).
5. Job R. *J. Chem. Educ.* 56, 556 (1979).
6. Mazurek H., Mehta R. S., Dresselhaus M. S., Dresselhaus G., Zeiger H. J. *Surf Sci.* 118, 530 (1982).
7. Korenev A. V., Shvartsman R. A., Mnukhin A. S., *Tsvetn. Met.* 1979 No 11, pp. 37.
8. Mehta R. S., Dresselhaus M. S., Dresselhaus G., Zeiger H. J. *Surf Sci.* 78, L681 (1978).
9. Greiner G., Manzel D. *J. Catal.* 77 382 (1982).

SUMMARY OF THE INVENTION

It is an object of the present invention to provide a method for producing an improved quality nickel, particularly, in the form of a powder.

It is a further object to provide a method of selectively reducing the ratio of metallic iron relative to metallic Ni, Cu and Co from the ratio of said metals in the form of their respective oxides in a starting composition comprising said oxides.

It is a further object to provide an improved method of producing activated nickel for subsequent carbonylation from a metallic admixture comprising metallic nickel, cobalt, copper and iron.

It is a further object to provide metallic nickel when made by said processes.

It is a further object to provide nickel carbonyl from the reaction of said metallic nickel with carbon monoxide and subsequent decomposition of said nickel carbonyl to metallic nickel, particularly, in the form of nickel powder.

It is a further object to provide apparatus of use in the aforesaid processes.

Accordingly, in one aspect, the invention provides an improved method of reducing a mixed metal oxide composition comprising oxides of nickel, cobalt, copper and iron in a hydrogen atmosphere to produce a mixture of the respective metals, the improvement wherein said atmosphere further comprises water vapour at a concentration, temperature and time to effect selective reduction of said oxides of nickel cobalt and copper relative to said iron oxide to produce said metallic mixture having a reduced ratio of metallic iron relative to metallic nickel, cobalt and copper.

The process is of value where the mixed metal oxide composition has an iron oxide content preferably of less than 4% w/w, more preferably less than 2% w/w, as found for example, in the mixed oxide composition obtained by the roasting of nickel matte smelter product, generally known as oxide calcine.

The hydrogen reduction process is, preferably, carried out at a temperature selected from about 350° C. to about 550° C., preferably, about 500° C.

The water vapour content in the hydrogen gas reductant atmosphere is, preferably, but not limited to, ranges from 10% to 50% by volume, and more preferably 30% v/v $H_2O$.

The reductant atmosphere may further comprise carbon monoxide and carbon dioxide, particularly, carbon monoxide and hydrogen contained in so-called "producer gas". The atmosphere preferably comprises the hydrogen and water in a ratio of 10:1 to 1:1 hydrogen to water, preferably, 3:1 $H_2$:$H_2O$, more preferably 10-50% v/v $H_2O$, and still more preferably, 25-35% v/v $H_2O$.

The carbon dioxide content in a carbon monoxide containing reducing gas should preferably be, but not limited to, $CO_2$/CO ratios by volume ranging between 1/2 and 5/1 and more preferably 2/1.

The resultant metallic mixture product according to the invention, when made by a process as hereinabove defined, is of particular value when used in a pre-sulphiding process as hereinafter defined.

In a further aspect, the invention provides a method of producing an activated metallic nickel from a metallic nickel for subsequent reaction with carbon monoxide, said method comprising pre-sulphiding said metallic nickel with hydrogen sulphide at a pressure selected from 1 to 3 atmospheres (100 to 300 kPa) and a temperature selected from 20-150° for an effective activation period of time.

In this specification and claims pressures may be considered to be partial pressures when an inert gas is also present.

In a preferred aspect, the metallic nickel is in admixture with one or more metals selected from cobalt, copper and iron wherein admixture is treated with said hydrogen sulphide to effect production of one or more sulphides, selected from copper sulphide, cobalt sulphide and iron sulphide.

In one embodiment, the aforesaid admixture is a metallic mixture product obtained by the reduction with gaseous $H_2$/$H_2O$ as hereinabove defined.

Preferably, the pre-sulphiding temperature is selected from 100-120° C. and the pressure is selected from 1 to 2 atmospheres (100 to 200 kPa).

Thus, in a further aspect, the invention provides an activated nickel when made by a pre-sulphiding method as hereinabove defined.

In a further aspect, the invention provides producing said purified nickel in the form of a powder.

In a further aspect, the invention provides apparatus for the production of high quality nickel from an impure nickel source composition comprising oxides of metals selected from the group consisting of nickel, iron, cobalt and copper, said apparatus comprising (i) a reducing chamber for containing said composition;

(ii) means for heating said composition to a temperature selected from 350° C.-650° C.;

(iii) means for providing said reducing chamber with a reducing gaseous atmosphere comprising hydrogen and water to operably produce a first admixture comprising metals selected from the group consisting of nickel, cobalt and copper;

(iv) non-carbonylation pre-sulphiding means for treating said first admixture with hydrogen sulphide at a temperature selected from 20°-150° C. to produce a second admixture comprising metallic nickel and metallic sulphides selected from copper and cobalt;

(v) carbonylation means for effecting carbonylation of said second admixture to produce nickel carbonyl; and (vi) decomposition means for effecting decomposition of said nickel carbonyl to said high purity nickel.

Thus, the present invention provides, principally, the production of refined nickel powders, while utilizing a most effective way of achieving sulphide activation of a wide variety of metallic nickel starting materials, particularly, impure metallic nickel feed materials containing substantial quantities of copper, iron and cobalt, prior to charging a carbonylation reactor at essentially atmospheric pressure, for the production of nickel carbonyl gas of desired strength, without the production of any liquid carbonyls, and subsequent decomposition of the carbonyl gas to yield nickel powders with predetermined, specific physical and chemical properties.

The present invention provides for the carbonylation reaction to be carried out at essentially atmospheric (100 kPa) pressure, and, accordingly, large scale commercial operations can readily be engineered for continuous operation.

The nickel activation step using $H_2S$, herein termed "pre-sulphiding" as hereinabove defined at relatively low temperatures, is effected most preferably in an oxygen-free, preferably, nitrogen atmosphere, preferably at a slightly-above atmosphere pressure (100 kPa) at room temperature or preferably at slightly above room temperature, depicted as $T_2$ in FIG. 1 and data presented in Table 2. Such pre-sulphiding can be accomplished in the feed bins, or in the transfer conveyor usually located between the reduction reactor and the feed bins. Alternatively, a portion of the sulphiding can be effectively accomplished in the carbonylation reactor per se, for example, by a continuous controlled addition of $H_2S$ to the incoming CO gas.

The apparatus further comprises apparatus for the production of high purity nickel from a metallic nickel source, comprising (a) non-carbonylation pre-sulphiding means for treating said nickel source with hydrogen sulphide at a temperature selected from 20° C. to 150° C. to produce activated nickel;

(b) carbonylation means for effecting carbonylation of said activated nickel to produce nickel carbonyl; and (c) decomposition means for effecting decomposition of said nickel carbonyl to said high purity nickel.

Yet further, the apparatus further comprises apparatus for the production of high quality nickel from an impure nickel source composition comprising oxides of metals and selected from the group consisting of nickel, iron, cobalt and copper, said apparatus comprising (i) a reducing chamber for containing said composition;

(ii) means for heating said composition to a temperature selected from 350° C.-650° C.;

(iii) means for providing said reducing chamber with a reducing gaseous atmosphere comprising hydrogen and water to operably produce a first admixture comprising metals selected from the group consisting of nickel, cobalt and copper;

(iv) non-carbonylation pre-sulphiding means for treating said first admixture with hydrogen sulphide at a temperature selected from 20°-150° c. to produce a second admixture comprising metallic nickel and metallic sulphides selected from copper and cobalt;

(v) carbonylation means for effecting carbonylation of said second admixture to produce nickel carbonyl; and (vi) decomposition means for effecting decomposition of said nickel carbonyl to said high purity nickel.

By the term "activation" as used in this specification, is meant the process of producing activated nickel which has the form to react expeditiously with CO at about 25 50° C. and 1-2 atmospheres (100 to 200 kPa) pressure, to produce nickel carbonyl.

BRIEF DESCRIPTION OF THE DRAWINGS

In order that the invention may be better understood, preferred embodiments will now be described by way of example only, with reference to the accompanying drawings, wherein.

DETAILED DESCRIPTION OF PREFERRED EMBODIMENTS

Figure 1:
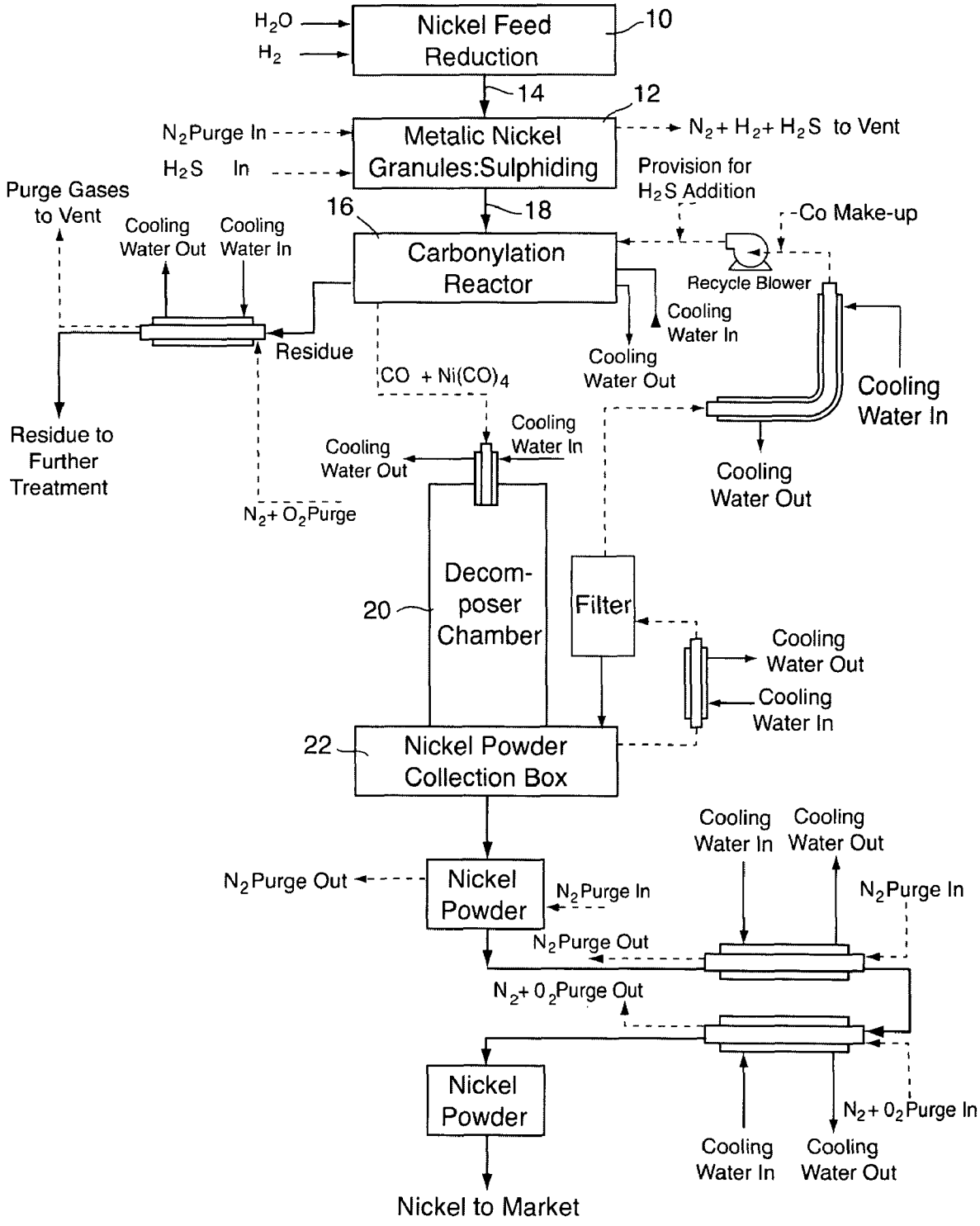
FIG. 1 is a diagrammatic representation of apparatus and process for the production of high purity nickel from impure nickel, according to the invention.

FIG. 1 shows apparatus and process constituents for making nickel powder from an impure nickel feed, which apparatus and process involve known steps of nickel feed preparation, carbonylation of nickel with carbon monoxide and subsequent decomposition of resultant nickel carbonyl to metallic nickel.

In the apparatus and process of the present invention, a nickel feed comprising oxides of Ni, e, Cu and Co are reduced in an atmosphere of 30% v/v $H_2O$-70% v/v $H_2$ at a temperature of about 500° C. to produce a composition of metals of Ni, Cu and Co, in chamber 10.

This composition, cooled to room temperature, is fed to a pre-sulphiding chamber 12 by feed conduit 14 and treated with $H_2S$ at a temperature of 20-60° C. and slightly above atmospheric pressure, to effect selective sulphidization of Co and Cu over Ni, while activating the nickel to an appreciable degree. This resultant activated nickel is fed to carbonylation reactor 16 via feed conduit 18. Subsequent carbonylation to nickel carbonyl and decomposition thereof in chamber 20 results in nickel powder being collected in box 22. Preferred temperatures and gas and water circulation steps are shown in FIG. 1.

With reference to the Figures, the notations shown therein denote the following:—

Figure 2:
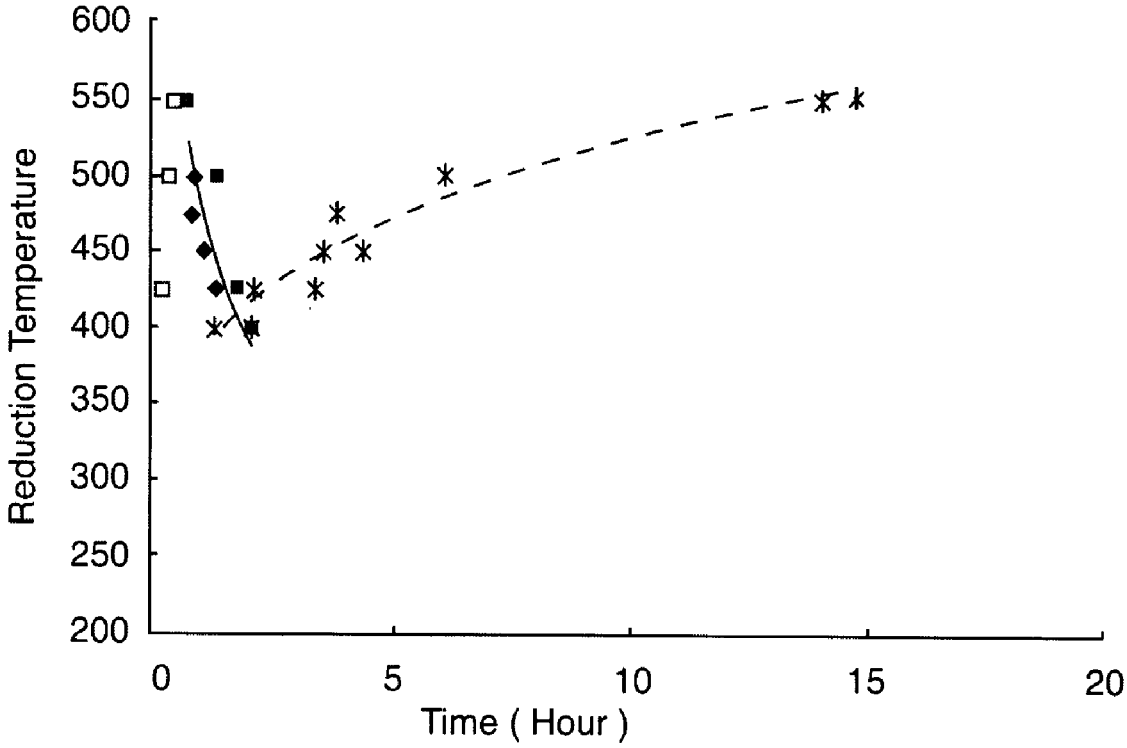
FIG. 2 is a graph of TGA Tests that show the effect of reduction temperature on sulphiding, at 10 kPa, 50° C. of FBR Calcine (Sample E)

In FIG. 2

Figure 3:
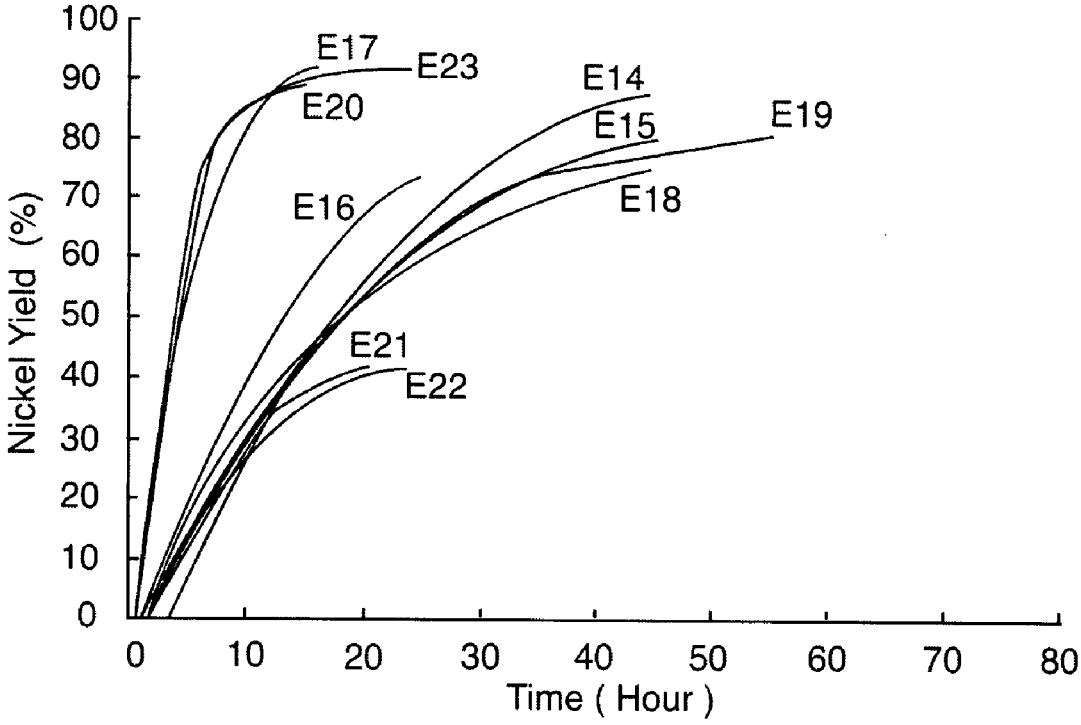
FIG. 3 is a graph of TGA Tests that show the carbonylation of impure nickel matte calcine, material "E" at atmospheric (100 kPa) pressure and 50° C., after reduction in hydrogen and subsequent pre-sulphiding to various activation levels.

- ♦Reduction time in hydrogen, Hours
- ✳Sulphiding Time for 6% wt gain, Hours—after reduction in pure hydrogen
- ■ Reduction time in 30% $H_2O$-70% H2 gas mixture. Hours
- □ Sulphiding Time for 6% wt gain, Hours—after reduction in 30% $H_2O$-70% H2 gas mixture In FIG. 3

Figure 4:
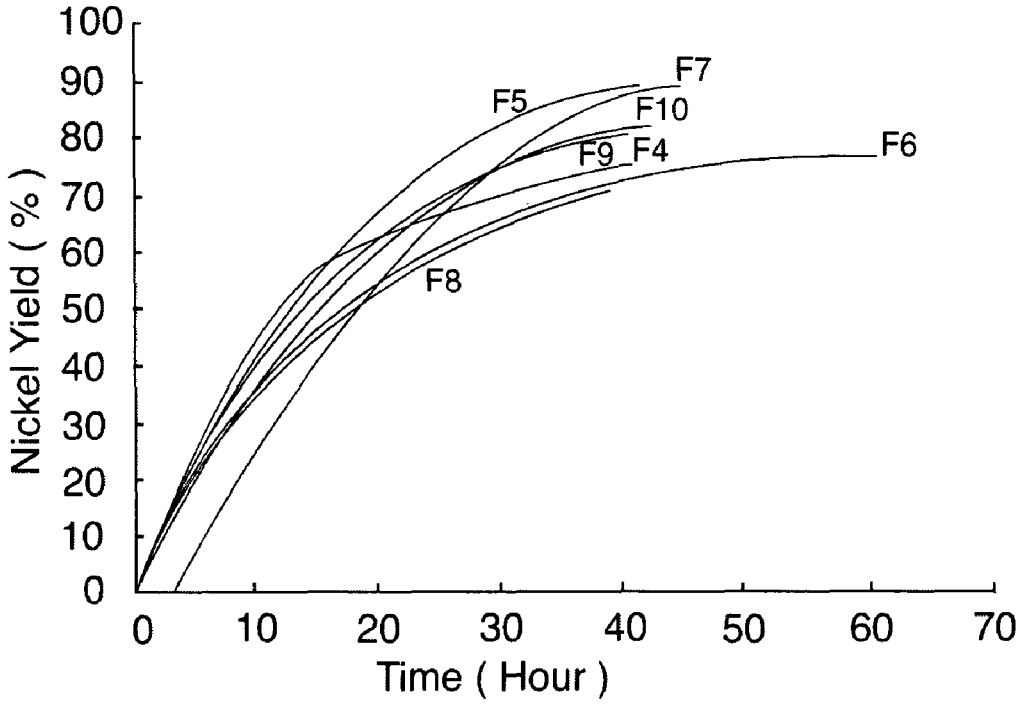
FIG. 4 is a graph of TGA Tests that show the carbonylation of impure nickel matte calcine, Material "F" at atmospheric (100 kPa) pressure and 50° C., after reduction in hydrogen and subsequent pre-sulphiding to various sulphur activation levels.

- - - E21—sample weight=5.3 g, reduction at 425 oC, 1% sulphur, (30 oC Carbonylation)
- - - E18—sample weight=5.5 g, reduction at 425 oC, 2% sulphur
- —E19—Sample weight=5.5 g, reduction at 425 oC, 4% sulphur
- —E14—Sample weight=5.5 g, reduction at 425 oC, 6% sulphur
- —E16—sample weight=5-6 g, reduction at 425 oC, 6% sulphur
- —E17—sample weight=1-6 g, reduction at 425 oC, 6% sulphur
- —E20—sample weight=2.0 g, reduction at 425 oC, 6% sulphur
- —E22—sample weight=5-5 g, reduction at 500 oC, 2% sulphur
- —E15—sample weight=5.6 g, reduction at 500 oC, 6% sulphur
- —E23—sample weight =2.09, reduction at 500 oC, 6% sulphur In FIG. 4

Figure 5:
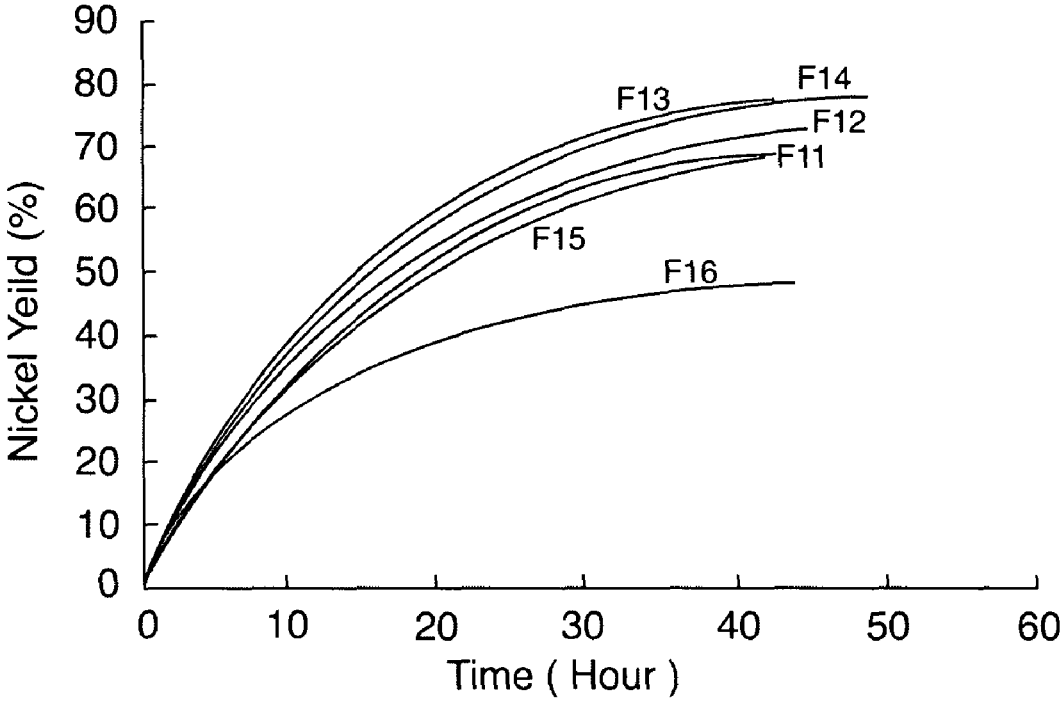
FIG. 5 is a graph of TGA Tests that show the carbonylation of impure nickel matte calcine, Material "F" at atmospheric (100 kPa) pressure and 50° C., after reduction in 30% v/v $H_2O$-70% v/v $H_2$ at 500° C.; and after pre-sulphiding at various temperatures to various sulphur activation levels.

- —F4—reduction at 425 oC, 2% sulphur
- —F5—reduction at 425 oC, 4-5% sulphur
- —F6—reduction at 425 oC, 6% sulphur
- —F9—reduction at 500 oC, 4% sulphur
- —F10—reduction at 500 oC, 4.5% sulphur
- —F7—reduction at 500 oC, 4.5% sulphur
- F8—reduction at 500 oC, 6% sulphur In FIG. 5

Figure 6:
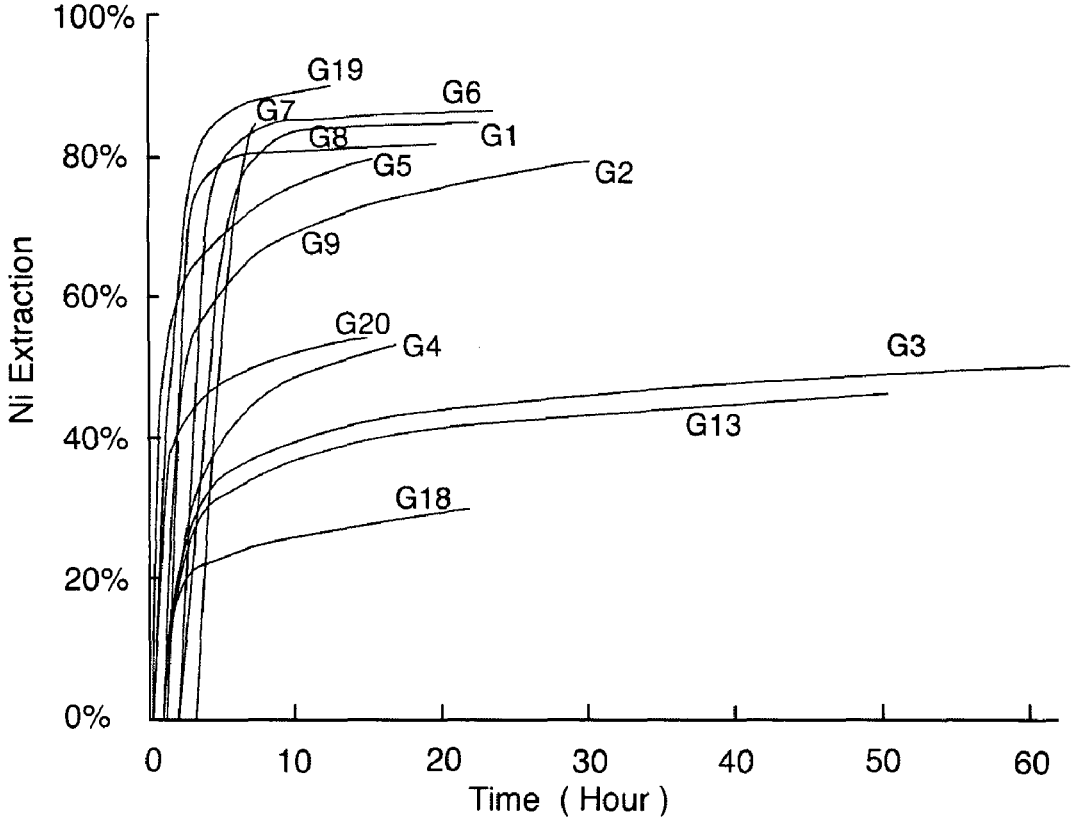
FIG. 6 is a graph of carbonylation of nickel-cobalt hydroxide material under various reduction and carbonylation conditions, but without sulphiding.

- —F11—2 wt % S at 50 oC atmospheric
- —F12—4.5 wt % S at 50 oC 100 kPa
- —F13—3 wt % S at 100 oC atmospheric
- —F14—3 wt % S at 120 oC atmospheric
- —F15—3 wt % S at 135 oC atmospheric
- —F16—3 wt % S at 150 oC atmospheric In FIG. 6

Figure 7:
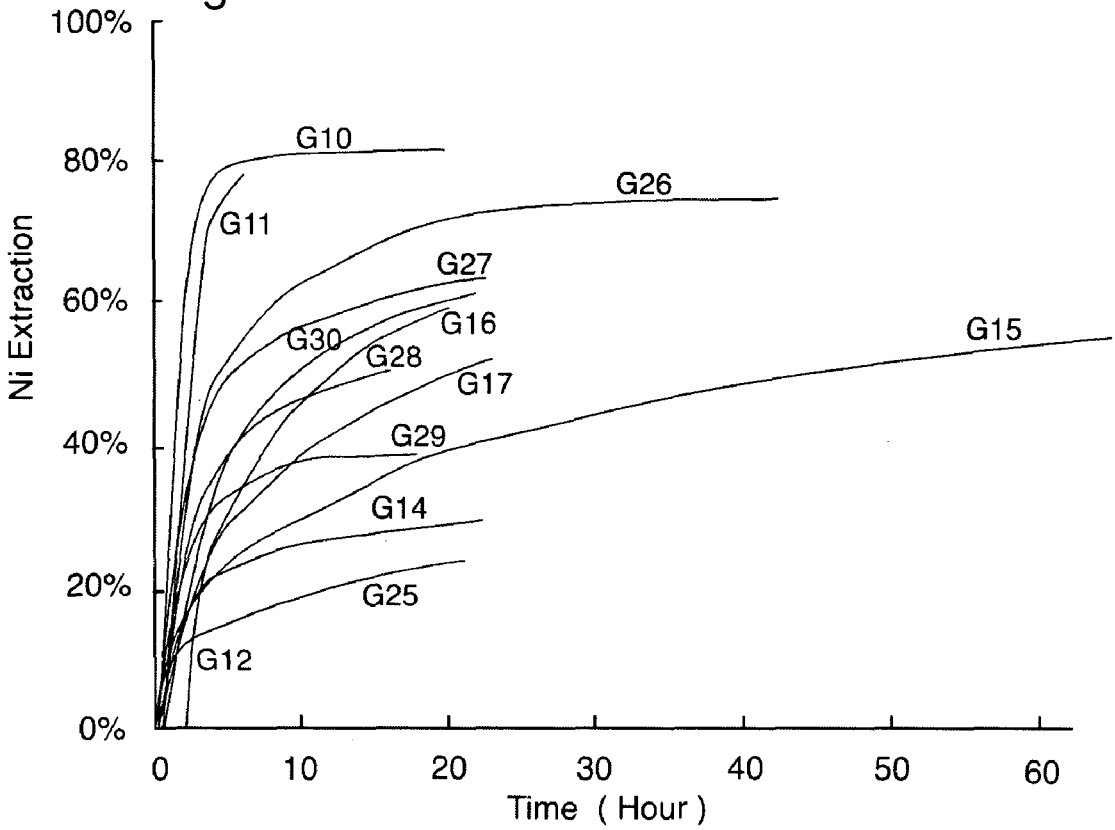
FIG. 7 is a graph of carbonylation of nickel-cobalt hydroxide material under various reduction and carbonylation conditions, under varying degrees of pre-sulphiding activation.

- —G1—Reduction in H2 at 300 oC, Carbonylation 30 oC 1000 kPa
- —G2—Reduction in H2 at 350 oC, Carbonylation 30 oC 1000 kPa
- —G3—Reduction in H2 at 400 oC, Carbonylation 50 oC 0 kPa
- —G4—Reduction in H2 at 400 oC, Carbonylation 30 oC 100 kPa
- —G5—Reduction in H2 at 400 oC, Carbonylation 30 oC 700 kPa
- —G6—Reduction in H2 at 400 oC, Carbonylation 50 oC 700 kPa
- —G7—Reduction in H2 at 400 oC, Carbonylation 30 oC 1000 kPa
- —G8—Reduction in H2 at 400 oC, Carbonylation 50 oC 1000 kPa
- —G9—Reduction in H2 at 400 oC, Carbonylation 85 oC 1000 kPa
- —G13—Reduction in H2 at 500 oC, Carbonylation 30 oC 0 kPa
- —G18—Reduction in H2 at 500 oC, Carbonylation 50 oC 0 kPa
- —G19—Reduction in H2 at 500 oC, Carbonylation 30 oC 1000 kPa
- —G20—Reduction in H2 at 500 oC, Carbonylation 85 oC 1000 kPa In FIG. 7

- —G14—Reduction in H2 at 450 oC, 0% wt S, Carbonylation 50 oC 0 kPa
- —G15—Reduction in H2 at 450 oC, 10% wt. S, Carbonylation 50 oC 0 kPa
- —G16—Reduction in H2 at 450 oC, 2.5% wt. S, Carbonylation 50 oC 0 kPa
- —G17—Reduction in H2 at 450 oC, 5% wt. S, Carbonylation 50 oC 0 kPa
- —G10—Reduction in H2 at 400 oC, O-60% wt. S, Carbonylation 50 oC 700 kPa
- —G11—Reduction in H2 at 400 oC, 2-00% wt. S, Carbonylation 50 oC 100 kPa
- —G12—Reduction in H2 at 400 oC, 7.00% wt. S, Carbonylation 50 oC 100 kPa
- —G25—Reduction in H2 at 400 oC, 0% wt. S, Carbonylation 50 oC 100 kPa
- —G26—Reduction in H2 at 400 oC, 2-00% wt. S, Carbonylation 50 oC 100 kPa
- —G27—Reduction in H2 at 400 oC, 2.00% wt. S, Carbonylation 50 oC 100 kPa
- —G28—Reduction in H2 at 400 oC, Carbonylation 50 oC 100 kPa CO-8% H2S
- —G29—Reduction in H2 at 400 oC, Carbonylation 50 oC 100 kPa CO-0.02% H2S
- —G30—Reduction in H2 at 400 oC, 3% wt. S. Carbonylation 50 oC 100 kPa Various nickel containing materials, their sources and compositions are shown in Table 1, by way of example only. The present invention is applicable to a wide variety of similar compositions or the treatment of relatively pure metallic nickel.

Nickel-containing feed can be provided from various sources and in several different chemical and physical forms, having the nickel as metal, sulphide, oxide, hydroxide, or carbonate. Thus, the feed preparation step is tailored to the nature of the source nickel. For example, in the case of nickel matte emanating from smelters, the nickel usually contains 20 or more percent w/w of sulphur, and usually contain other metals, such as copper, cobalt, iron and impurities, such as silicate materials, and, often, will also contain minor, but valuable quantities of precious metals.

In preparing such matte in the practise of the present invention, it is preferable that the matte be in granular form before being passed on to a roasting step at elevated temperatures that could be as high as 1150° C. This eliminates sulphur and converts all of the base metals to oxides. The resulting oxide granules are passed to a reduction step, normally at temperatures between 350° C.-650° C. to provide the nickel in granular metallic form. If the nickel source is a hydroxide or carbonate, a single heating-reduction step is adequate to provide the nickel as metallic fines. These metallic nickel forms are acceptable for carbonylation in the practise of the present invention.

TABLE 2

Pre-Sulphiding of High Grade Nickel Granules (TGA Tests)

| Sample ID | % Nickel | Mesh Size | Sulphiding Temperature ° C. | Pressure of $H_2S$, psi | Sulphiding Time, Hours | Sulphur pick-up by the nickel, wt. % |
|---|---|---|---|---|---|---|
| A1 | 99+ | −100 | 50 | 30 | 7.5 | 0.65 |
| A2 | 99+ | −100 | 25 | 45 | 7.5 | 0.51 |
| A3 | 99+ | −100 | 25 | 30 | 7.5 | 0.25 |
| B1 | 99+ | −100 | 25 | 30 | 7.5 | 0.19 |
| B2 | 99+ | −100 | 25 | 45 | 7.5 | 0.20 |
| B3 | 99+ | −100 | 50 | 45 | 7.5 | 0.24 |
| C1 | 95+ | −48 | 25 | 30 | 7.5 | 0.30 |
| C2 | 95+ | −48 | 25 | 45 | 7.5 | 0.45 |
| C3 | 95+ | −48 | 50 | 30 | 7.5 | 0.67 |
| C4 | 95+ | −48 | 50 | 45 | 7.5 | 0.98 |

TABLE 1

Materials Identification

| Sample ID | Materials Tested | Composition, wt. % |
|---|---|---|
| A | Nickel Granules, Australian Commercial Source: final product from a leaching operation | 99% Ni, 0.11% Co, 0.03% Fe, Balance oxygen |
| B | Nickel Granules, Canadian Commercial Source: final product from a leaching operation | 99% Ni, 0.15% Co, 0.034 Fe, Balance Oxygen |
| C | Nickel Granules, Japanese Commercial Source: Nickel matte granules fluid bed roasted and subsequently fluid bed reduced | 95.5% Ni, 0.20% Cu, 1.4% Co, 0.60% Fe, Balance oxygen |
| D | Sinter 75 nickel oxide, Japanese Commercial Source: nickel matte granules fluid bed roasted to oxide | 77% Ni, 0.65% Cu, 1.11% Co, 0.38% Fe, Balance oxygen |
| E | Calcine Granules: produced by fluid bed roasting in a pilot plant operation, of impure matte granules, high in copper and iron coming from a Chinese commercial smelting operation | 59% Ni, 16% Cu, 0.92% Co, 4.07% Fe, 0.05% S, Balance oxygen |
| F | Calcine Granules: produced by laboratory roasting, of impure matte granules, high in copper but lower in iron than "E", from the same Chinese commercial smelting operation | 62% Ni, 12% Cu, 0.94% Co, 2.1% Fe, 0.01% S, Balance oxygen |
| G | Nickel hydroxide intermediate material: recovered by lime precipitation of liquor obtained by acid leaching of nickel laterite ore | 32% Ni, 4.46% Co, 0.08% Fe, 5.55% Mn, 0.53% Cr, 0.70% Zn (b) 13.4% Ni, 0.58% Co, 0.35% Fe, 0.78% Mn, 0.06% Zn (c) 11.5% Ni, 0.94% Co, 0.55% Fe, 0.36% Mn, 0.10% Zn |

The nickel granular or fine feed, that may already be activated by reaction with $H_2S$, is fed to a carbonylation reactor chamber wherein the exothermic carbonylation reaction of nickel with carbon monoxide is carried out. The reactor, for example, may be either a packed bed or a moving bed type, wherein moving bed type is either a rotary bed or a fluid bed. The reactor is provided with cooling means whereby the excess heat generated by the reaction is effectively removed.

Carbonylation was found to proceed at reasonable/practical rates at temperatures as low as 38° C. and as high as 80° C. when operating at essentially atmospheric pressure, or just modestly above atmospheric pressure, with temperatures in the narrow range of 50° C. to 60° C. proving to be optimum in many cases, as seen in Table 3, hereinafter.

Nickel carbonyl-laden carbon monoxide leaving the reactor chamber, after passing through a filter, held essentially at reactor temperature (35-60° C.), is fed to a decomposer chamber through a cooled feed nozzle to prevent decomposition occurring in the nozzle as gas is introduced into the decomposer chamber in which the temperature, $T_8$, (250-450° C.) is normally set at temperatures above 250° C. At the same time, the feed nozzle is not below about 45° C. to avoid production of undesirable liquid nickel carbonyl. Accordingly, water cooling of the feed nozzle is closely controlled to yield a cooling outlet temperature, $T_7$, between 40°-60° C.

FIG. 1 illustrates a preferred process and apparatus of use in the practise of the invention wherein temperatures and material flows are shown.

In the aforesaid process, over 99% of the nickel carbonyl is decomposed and collected in the collection box.

EXAMPLES

Example 1

Sulphiding and Carbonylation of Nickel Metallic Granules

Metallic nickel granules containing 99+% Ni essentially free of any sulphur, and of minus 100 mesh size, Test "A5", were charged to an oxygen-free reactor chamber that had been purged with nitrogen gas, and a first quantity of hydrogen sulphide was introduced into the chamber at a pressure of 200 kPa. The chamber was sealed off and the nickel was held at this slightly elevated pressure for 8 hours at room temperature of around 25° C. The resulting nickel granules analyzed for 0.11 w/w % S.

Some 2.8 kilograms of these sulphided granules were charged to a rotary kiln-type oxygen-free moving bed mini-pilot plant reactor which had been purged with nitrogen gas. A continuous stream of carbon monoxide of about 8 times in excess of stoichiometric requirements and a second small quantity of hydrogen sulphide was introduced to the chamber, at essentially atmospheric pressure, while the temperature in the reactor was held at about 40° C. The gases exiting the reactor chamber contained over 10% by volume of nickel carbonyl during the first 6 hours, which gradually dropped to around 8% v/v after 24 hours. The exit gas contains about 2% when the reaction was stopped before the reaction had reached completion. The carbon monoxide plus nickel carbonyl product gases were passed directly to a mini-pilot plant powder decomposer (described in Example 2 hereinafter), that was controlled at a decomposition temperature of around 400° C. The nickel powder collection box was maintained at a temperature above 170° C. After stopping the flow of carbon monoxide to the carbonylation reactor, the system was allowed to cool down while being purged with nitrogen gas, and the powder was cooled to room temperature of around 25° C. Some 72% of the nickel in the metallic granules had been converted to nickel powder of 0.06 w/w % S with a density of 1.12 g/cc.

In a related series of tests in a Thermo Gravimetric Analyzer (TGA), sulphiding of metallic nickel granules demonstrated sulphur pick-up efficiency at low temperatures. As seen in Table 2, the "B" sourced nickel granules were less active, i.e., they sulphided at considerably slower rates than either the "A" or "C" nickel granules.

Subsequently, in each case the three sources of nickel granules after sulphiding, were carbonylated in mini-pilot plant reactors, either in a packed bed reactor or in a rotary kiln reactor. The results are summarized in Table 3. Again, the "B" sourced nickel granules reacted more slowly with the carbon monoxide to form nickel carbonyl than the other two sourced nickel materials.

In test C5, impure 95.5% Ni granules produced from granulated nickel matte that had been roasted in a commercial fluid bed reactor at 1100° C. and then reduced in a commercial fluid bed reducer with hydrogen at around 800° C., was first sulphided at 60° C. for 6 hours in a nitrogen atmosphere with a $H_2S$ gauge pressure of 300 kPa. This product was subsequently charged in a packed bed and subjected to reaction with carbon monoxide at essentially atmospheric pressure. Additional $H_2S$ had been added to the carbon monoxide inlet gas to the reactor representing, in total, a pick-up of sulphur of 1.7 w/w % of the nickel charge, and the nickel carbonyl gas strength, as measured by a UV analyzer, averaged around 6 v/v % for most of the reaction period.

The product gases from the reactor were passed through the decomposer described in Example 2. The nickel powder product had a bulk density of 0.55 g/cc, but an elevated, undesirable sulphur content of 1.29 w/w %. The residue analyzed 3.38% S.

Example 2

Decomposition of Nickel Carbonyl and Collection of the Nickel Powders

In a series of tests, a carbon monoxide gas stream containing varying concentrations of nickel carbonyl gas, was passed through a mini-pilot plant decomposer reactor chamber, 12 cm in diameter and 75 cm long held at various temperatures and fed at various flow rates to produce nickel powders, and the nickel powders were collected in a collection box 30 cm in diameter and 30 cm long held at various temperatures.

TABLE 3

Mini-Pilot Plant Tests: Sulphiding and Carbonylation of high grade Metallic Nickel Granules; Materials "A", "B" and "C"

| | | Sulphiding | | | | Carbonylation | | | | | | |
|---|---|---|---|---|---|---|---|---|---|---|---|---|
| Sample ID | Sample size, g | H2S Pressure PSI | Temp. ° C. | Time, Hours | w/w % S added | Temp. ° C. | Time, Hours | Extraction % Nickel | w/w % S in product | Density of product g/cc | Average size product microns | w/w % S in Residue |
| A5*, ++ | 2800 | 30 | 20 | 8 | 0.11 | 40 | 48 | 72 | 0.06 | 1.12 | 2.40 | 0.25 |
| A7* | 2800 | 30 | 20 | 8 | 0.08 | 55 | 48 | 70 | 0.02 | 0.72 | 1.50 | 0.22 |
| A9* | 2800 | 30 | 20 | 8 | 0.11 | 50 | 48 | 76 | 0.06 | 0.35 | 0.95 | 0.25 |
| A10** | 600 | 45 | 60 | 4 | 0.40 | 25 | 48 | 79 | 0.06 | 1.99 | 3.60 | 1.63 |
| A11*, ++ | 2800 | 30 | 50 | 8 | 0.16 | 50 | 48 | 77 | 0.05 | 0.67 | 2.00 | 0.54 |
| B4* | 3800 | 21 | 65 | 8 | 0.10 | 55 | 48 | 51 | 0.04 | 0.70 | 2.00 | 0.17 |
| B5* | 3800 | 21 | 50 | 8 | 0.12 | 50 | 31 | 45 | 0.06 | 0.65 | 1.80 | 0.19 |
| C5**, + | 300 | 45 | 60 | 6 | 1.68 | 60 | 45 | 85 | 1.29 | 0.55 | 1.50 | 3.38 |

*Rotary kiln reactor

**Packed bed reactor

+Continuous high strength $H_2S$ (in CO) was introduced from the start of carbonylation (50 cc/min of 8% $H_2S$ in CO)

++Continuous low strength $H_2S$ (in CO) was introduced after 10 hours of carbonylation (1.9 cc/min of 8% $H_2S$ in CO)

TABLE 4

Decomposition of Nickel Carbonyl and Collection of the Nickel Powder

| Decomposer Temperature ° C. | Nickel Carbonyl Feed Rate g/min | Nickel Carbonyl Strength, % $Ni(CO)_4$ by volume | Collection Box Temperature ° C. | Density of Powder g/cc | Remarks |
|---|---|---|---|---|---|
| 390* | 8.5 | 16.5 | RT (~25°) | N/A | Liquid carbonyl collected in the box and agglomerated much of the powder. |
| 355 | 10.8 | 21.2 | 170 | 1.5 | No liquid carbonyl |
| 380 | 6.6 | 14.1 | 150 | 1.2 | No liquid carbonyl |
| 360 | 10.0 | 5.7 | 120 | 1.1 | No liquid carbonyl |

*A smaller mini-pilot plant decomposer was employed in this first test: 5 cm in diameter and 60 cm long.

The results of these tests, summarized in Table 4, clearly demonstrated the importance of controlling the temperature in the powder collection box in order to prevent re-carbonylation of the product nickel powder. By holding the temperature above 120° C. the production of liquid nickel carbonyl in the collection box was avoided, while 99+% of the gaseous nickel carbonyl was decomposed yielding nickel powders and a carbon monoxide suitable for recycle to the reactor chamber.

Example 3

Treatment of an Impure Nickel Matte Feed Material

A laboratory-sized sample of nickel matte analyzing 59.8% Ni, 10.5% Cu, 0.9% Co, 3.2% Fe and 21.0% S by weight, was roasted at temperatures starting at around 650° C. and gradually increased to 1050° C. for essentially complete elimination of the sulphide sulphur. The resulting oxide calcine was subsequently reduced with hydrogen at a temperature of 450° C. A 250 gram sample of the reduced material was charged to a packed bed reactor and reacted with carbon monoxide gas at 60° C., without any sulphiding pre-activation, at 50° C., but with excess activating hydrogen sulphide amounting to a total of some 6.5% by weight of the metallic charge added to the carbon monoxide. The reactor product gases were fed directly to a heated tube decomposer which recovered the nickel in solid plated form. Without the pre-activation of the metallic charge, the gas strength in the reactor product gases was very low at about 2 v/v % nickel carbonyl, while the nickel product plate was high in sulphur at 2.2 w/w % as a result of excessive $H_2S$ presence in the CO. This test shows that while a measure of pre-activation of the metallic charge is useful, the amount of activating $H_2S$ gas added to the carbon monoxide during carbonylation should be very much reduced.

Example 4

Treatment of an Impure High-nickel Nickel Oxide Feed Material 500 kilograms, of granular nickel oxide containing 77 w/w % Ni, containing minor quantities of cobalt, iron and sulphur was fed to a pilot plant rotary kiln reactor of about 46 cm in diameter, a heating zone 200 cm long, and a cooling zone, at a feed rate of about 1 kilogram per hour. The feed was reduced with hydrogen gas at a temperature of 425° C. in a continuous manner with retention in the hot reducing zone of about 2 hours. The nickel oxide was 90% reduced. 300 grams of this 90% reduced material, was further reduced to completion in a small laboratory packed bed reactor at 425° C., some pre-sulphiding with $H_2S$ at 50° C. was carried out, and the sample was then subjected to atmospheric carbonylation at 50° C. Continuous activation of the nickel was effected by continuous addition of hydrogen sulphide with the carbon monoxide. After 30 hours, some 90% of the nickel was extracted. However, as an excessive amount of activation sulphur had been added totalling some 0.73% of the metallized feed, the product nickel powder had an undesirable elevated content of sulphur of 0.52%.

In a second test, more sulphur was added during pre-sulphiding and less hydrogen sulphide was added to the carbon monoxide incoming gas, but also only after some 10 hours of initial carbonylation. The metal product powder had an acceptable low-sulphur content of 0.08 w/w %, as seen in Table 5. However, the degree of nickel extraction after 28 hours had dropped to 60%.

TABLE 5

Mini-Pilot Plant Tests: Reduction, Sulphiding and Carbonylation of high grade Nickel Oxide Granules; Material "D"

| | | | Sulphiding | | | | Carbonylation | | | | | | |
|---|---|---|---|---|---|---|---|---|---|---|---|---|---|
| Sample ID | Sample size, g | Reduc'. Temp. ° C. | H2S Pressure PSI | Temp ° C. | Time, Hours | % w/w S added | Temp. ° C. | Time, Hours | Extraction % Nickel | % w/w S in product | Density product g/cc | Average size of product microns | % w/w S in Residue |
| D1+,** | 300 | 425 | 30 | 50 | 6 | 0.73 | 50 | 30 | 90 | 0.52 | DC | DC | 2.10 |
| D2**, ++ | 600 | 425 | 30 | 50 | 16 | 0.85 | 50 | 28 | 60 | 0.08 | DC | DC | 1.90 |

**Packed bed reactor

+Continuous high strength $H_2S$ (in CO) was introduced from the start carbonylation (50 cc/min of 8% $H_2S$ in CO)

++Continuous low strength $H_2S$ (in CO) was introduced after 10 hours of carbonylation (1.9 cc/min of 8% $H_2S$ in CO)

Example 5

Processing of Impure Nickel Matte for the Production of Refined Carbonyl Nickel Powder, in Mini-Pilot Plant Reactor In a series of tests, a granular nickel matte containing substantial quantities of copper and iron impurities, obtained from a commercial nickel smelter was roasted in a pilot plant fluid bed roaster of 20 cm diameter, at temperatures between 1070° C. and 1100° C. The resulting calcine, material "E", in Table 1, contained 59% Ni, 16% Cu, 0.9% Co, 4% Fe and less than 0.1% S. This calcine was subsequently reduced with hydrogen at temperatures between 400° C. and 500° C., subsequently sulphided with $H_2S$ under varying conditions, and reacted with carbon monoxide at 50° C. to 55° C. and at essentially atmospheric pressure, i.e., below 100 kPa, and in most cases below about 35 kPa in a mini-pilot plant carbonylation reactors. The gases exiting the reactors containing nickel carbonyl were directed to the mini-pilot plant powder decomposer held at 400° C. (except in Test E5). The nickel and iron extractions, sulphur analyses of feed, product and residue, and density of product powders are summarized in Table 6. In all cases, carbonylation/extractions were still proceeding when the tests were stopped.

In test E5, all of the activation sulphur was added continuously as H2S to the incoming CO gas stream, which resulted in high pick-up of sulphur and high nickel extraction. However, a considerable proportion of the added sulphur ended up in the product nickel plate (2.2% w/w S).

In test E6, activation sulphur was added to the reduced metal by reacting a gaseous mixture of 90 v/v % H2/10 v/v % $SO_2$, with the metal prior to carbonylation; and further addition of H2S gas was added during carbonylation. It is seen in Table 6 that nickel extractions improved with the higher level of sulphur additions, and that pre-sulphiding with no subsequent addition of $H_2S$ to the CO stream yielded nickel powder low in sulphur content. It is believed that the higher sulphur levels tie up more of the copper impurity thereby "freeing" more of the nickel for reaction with the carbon monoxide. Furthermore, it is also believed that reduction at the higher temperature of 500° C. suppresses, to some degree, subsequent extraction of the iron impurity.

TABLE 6

Mini-Pilot Plant Tests: Reduction, Sulphiding and Carbonylation of Impure Matte Calcine Granules; Material "E"

| | | | Sulphiding | | | | Carbonylation | | | | | | | |
|---|---|---|---|---|---|---|---|---|---|---|---|---|---|---|
| | | | | | | | | | Extraction | | | | Average | |
| Sample ID | Sample size, g | Reduc. Temp. ° C. | H2S Pressure PSI | Temp. ° C. | Time, Hrs. | % w/w S added to metal Calcu'd | Temp. ° C. | Time, Hrs. | w/w % Nickel | w/w % Iron | % w/w S in product | Density product g/cc | size of product microns | w/w % S in Residue |
| E5**, + | 250 | 425 | 15 | 50 | 0 | 4.11 | 50 | 48 | 90 | 70 | 2.20 | DC | DC | 8.78 |
| E6*, ++ | 2000 | 450 | 15 | 350 | 8 | 0.82 | 50 | 48 | 47 | 58 | 0.20 | 0.80 | 0.85 | 1.20 |
| E7* | 3000 | 425 | 105 | 50 | 8 | 2.19 | 55 | 44 | 67 | 66 | 0.05 | 1.26 | 1.10 | 4.57 |
| E8* | 3000 | 450 | 105 | 50 | 8 | 1.26 | 55 | 35 | 60 | 50 | 0.03 | 0.40 | 2.10 | 2.37 |
| E9* | 3000 | 425 | 105 | 50 | 8 | 1.71 | 55 | 48 | 70 | 61 | 0.03 | 0.50 | 1.40 | 3.81 |
| E10* | 1500 | 425-500 | 55 | 50 | 8 | 1.00 | 50 | 48 | 47 | 10 | 0.10 | 1.73 | 1.50 | 1.50 |
| E11* | 1500 | 500 | 55 | 50 | 8 | 0.86 | 50 | 70 | 53 | 10 | 0.20 | 1.38 | 1.20 | 1.30 |
| E12*, ++ | 3000 | 425 | 105 | 50 | 8 | 1.66 | 50 | 26 | 50 | 31 | 0.20 | 0.21 | 0.90 | 2.60 |
| E13** | 406 | 500 | 30+++ | 100 | 8.5 | 5.52 | 50 | 48 | 53 | 11 | 0.03 | 2.02 | 0.90 | 9.20 |

*Rotary kiln reactor

**Packed bed reactor

+Continuous high strength $H_2S$ (in CO) was introduced from the start of carbonylation (50 cc/min of 8% $H_2S$ in CO)

++Continuous low strength $H_2S$ (in CO) was introduced after 10 hours of carbonylation (1.9 cc/min of 8% $H_2S$ in CO)

+++30 psi pressure of hydrogen sulphide repeated 17 times

DC—Deposit plated onto a copper tube

Example 6

TGA Tests* Related to the Processing of Impure Nickel Matte Products

Comprehensive series of TGA (Thermo Gravimetric Analyzer) tests were carried out on impure nickel oxide/calcine granules to study the effects of reduction temperature, and of varying the degree of low-temperature pre-sulphiding on subsequent nickel and iron carbonylation extractions.

Material "E", similar to that of Example 5, was the source of feed for these tests. Another series of tests was carried out on material "F" as the feed. Reduction temperatures were varied, pure hydrogen was employed for reduction, in one series on Material "E", while addition of $H_2O$ to the hydrogen gas in another test series on material "E" was carried out. Pre-sulphiding was effected in all cases at 50° C., and carbonylation was carried out at atmospheric (100 kPa) pressure and 50° C., except in tests E16 and E21 where carbonylation was carried out at 30° C. The results with material "E" are summarized in Tables 7 and 8, and in FIGS. 2 and 3.

It can be seen that nickel carbonyl extractions were higher with the nickel oxide/calcine reduced at the lower temperature of 425° C. as compared to 500° C. Also, nickel extractions were higher at the higher sulphur levels, for example, with the 2% w/wS yielding a 74% extraction and 4.5% w/wS yielding 88% for material "F" in the same time period, (Test F4 versus F5). Tests E17, E20 and E23, which yielded nickel extractions as high as 91%, are characterized by smaller test samples. On the other hand, higher reduction temperature coupled with the higher sulphur addition, E23, suppressed iron extraction while yielding a high nickel extraction. In comparing iron extractions, there is a notable drop to about one-half, between the higher-iron feed material "E" and the lower-iron feed material The most surprising results with beneficial implications for commercial applications, are evident in tests F11 to F16, in which iron extraction is virtually completely suppressed by carrying out the preparatory reduction step in a hydrogen gas containing $H_2O$ vapour.

Also some surprising results with important processing implications are depicted in FIG. 2. When the reduction of the nickel oxide/calcine was carried out in pure hydrogen, the pre-sulphiding operation was distinctly slowed down as the reduction temperature was increased. However, when the reduction was carried out with hydrogen gas containing $H_2O$, subsequent sulphiding was extremely rapid.

It should be noted that the TGA Tests provide "relative" results as distinct from "absolute" results, particularly with regard to rates of reaction (i.e. reaction times) which rates depend to a large extent on the equipment configuration, on the selection of solid sample sizes and on gas flow rates.

Example 7

TGA Tests Related to the Processing of Impure Nickel Matte of the Lower Iron Content, Material "F"

Another comprehensive series of TGA tests was carried out on the impure nickel oxide/calcine granules Material "F", in which a range of weaker hydrogen gases diluted with $H_2O$, were employed for reduction, and in which the low-temperature activation sulphur levels were varied.

Material "F", Table 1, an impure matte calcine analyzing 62% Ni, 12% Cu, 2% Fe and 0.01% S, was produced in the laboratory by tray roasting of granulated matte feed at temperature up to 1050° C. While reduction temperatures gas strengths and sulphiding additions with $H_2S$ were varied, except in one test wherein sulphiding with elemental sulphur was attempted, the conditions for carbonylation at atmospheric (100 kPa) pressure and 50° C., were maintained constant. The results are summarized in Tables 9 and 10 and depicted in FIGS. 4 and 5.

It is seen that the lower reduction temperature of 425° C. yielded higher nickel and iron extractions than at the higher reduction temperatures, in the same period of carbonylation, as was already demonstrated in earlier examples. Optimum level of activation sulphur is around 4.5 w/w % S for material "F". Lowering the gas strength of reduction by the presence of $H_2O$ slowed the nickel reaction rate modestly. Most significantly, iron extraction was drastically lowered by the employment of the humid gaseous mixture of 30% v/v $H_2O$/70% v/v $H_2O$ during reduction. Furthermore, results summarized in Table 10 show that increasing sulphur above the 2% level helped suppress iron extraction, and that pre-sulphiding with H2S gas at temperatures between 70° C. and 135° C., and, preferably, between 100° C. and 120° C., yielded the best nickel extractions.

The tests carried out in Example 7, demonstrated that nickel products low in iron can be produced from impure matte calcine containing some 2 w/w % iron as compared with the impure matte calcine treated in Example 6, which contained the higher levels of iron.

Comparative results are summarized in Table 10 of treating 2 w/w % Fe materials with those of Table 8, of treating 4 w/w % Fe material, wherein the reduction were carried out with gases 0% v/v H2O/70% v/v $H_2$. Table 9 also demonstrated that pre-sulphiding by addition of elemental sulphur was not satisfactory.

TABLE 7

| | | | Sulphiding | | | | | | Extraction | | |
|---|---|---|---|---|---|---|---|---|---|---|---|
| Sample ID | Sample size, g | Reduc. Temp. ° C. | Pressure PSI | Temp. ° C. | Time, Hours | w/w % S added | Temp. ° C. | Time, Hours | % Nickel | % Iron | % S in Residue |
| TGA Tests*: Reduction, Pre-Sulphiding and Carbonylation of Impure Matte Calcine Granules; Materials "E" | | | | | | | | | | | |
| E14 | 5.5 | 425 | 30 | 50 | 1.5 | 6.00 | 50 | 44 | 87 | 35 | 12.20 |
| E15 | 5.6 | 500 | 30 | 50 | 11.0 | 6.00 | 50 | 42 | 79 | 29 | 13.00 |
| E16 | 5.6 | 425 | 30 | 50 | 2.0 | 6.00 | 30 | 24 | 73 | 22 | 14.00 |
| E17 | 1.6 | 425 | 30 | 50 | 1.5 | 6.00 | 50 | 16 | 91 | 31 | 15.40 |
| E18 | 5.5 | 425 | 30 | 50 | 0.5 | 2.00 | 50 | 44 | 74 | 49 | 7.10 |
| E19 | 5.5 | 425 | 30 | 50 | 1.0 | 4.00 | 50 | 60 | 79 | 38 | 14.4 |
| E20 | 2.0 | 425 | 30 | 50 | 1.2 | 6.00 | 50 | 44 | 87 | 35 | 15.1 |
| E21 | 5.3 | 425 | 30 | 50 | 0.2 | 1.00 | 30 | 80 | 67 | 54 | 2.50 |
| E22 | 5.5 | 500 | 30 | 50 | 3.5 | 2.00 | 50 | 24 | 42 | 31 | 3.90 |
| E23 | 2.0 | 500 | 30 | 50 | 9.5 | 6.00 | 50 | 23 | 91 | 7 | 14.90 |

TABLE 7-continued

| Sample ID | Sample size, g | Reduc. Temp. ° C. | Sulphiding Pressure PSI | Sulphiding Temp. ° C. | Sulphiding Time, Hours | Sulphiding w/w % S added | Extraction Temp. ° C. | Extraction Time, Hours | Extraction % Nickel | Extraction % Iron | Extraction % S in Residue |
|---|---|---|---|---|---|---|---|---|---|---|---|
| TGA Tests: Reduction, Pre-Sulphiding and Carbonylation of Impure Matte Calcine Granules; Materials "F" | | | | | | | | | | | |
| F4 | 5.5 | 425 | 30 | 50 | 0.4 | 2.00 | 50 | 44 | 74 | 21 | 4.47 |
| F5 | 5.5 | 425 | 30 | 50 | 1.0 | 4.50 | 50 | 44 | 88 | 22 | 6.20 |
| F6 | 5.5 | 425 | 30 | 50 | 1.3 | 6.00 | 50 | 68 | 77 | 8 | 7.24 |
| F7 | 5.5 | 500 | 30 | 50 | 10.0 | 4.50 | 50 | 44 | 88 | 15 | 7.70 |
| F8 | 5.5 | 500 | 30 | 50 | 16.0 | 6.00 | 50 | 44 | 74 | 12 | 7.30 |
| F9 | 5.5 | 500 | 30 | 50 | 8.10 | 4.00 | 50 | 44 | 82 | 14 | 5.65 |
| F10 | 5.5 | 500 | 30 | 50 | 9.05 | 4.50 | 50 | 44 | 84 | 5 | 6.10 |
| F11+ | 5.5 | 500 | 15 | 50 | 1.50 | 2.00 | 50 | 44 | 69 | 13 | NA |
| F12+ | 5.5 | 500 | 29 | 50 | 1.00 | 4.50 | 50 | 44 | 75 | ND | NA |
| F13+ | 5.5 | 500 | 29 | 100 | 0.33 | 3.00 | 50 | 44 | 79 | ND | NA |
| F14+ | 5.5 | 500 | 29 | 120 | 0.23 | 3.00 | 50 | 44 | 79 | ND | NA |
| F15+ | 5.5 | 500 | 29 | 135 | 0.20 | 3.00 | 50 | 44 | 70 | ND | NA |
| F16+ | 5.5 | 500 | 29 | 150 | 0.12 | 3.00 | 50 | 44 | 51 | ND | NA |

ND Not detectable

+Reduction with 70% v/v H2 - 30% v/v H2O

TABLE 8

TGA Tests: Carbonylation (Atm., 50° C.) of Reduced Matte Calcine (Sample "E" with 4% Fe); Effect of varying reducing gas strength, oxidation Potential and reduction temperature, and of varying sulphide activation levels

| Reduction Temperature ° C. | | Sulphiding level: 1.0% Reduction atm 100% $H_2$ | 1.0% Reduction atm 100% $H_2$ | 2.0% Reduction atm 100% $H_2$ | 4.0% Reduction atm 100% $H_2$ | 6.0% Reduction atm 100% $H_2$ | 4.5% Reduction atm 30% $H_2O$/70% $H_2$ | 6.0% Reduction atm 30% $H_2O$/70% $H_2$ | 6.0% Reduction atm 50% $H_2O$/50% $H_2$ |
|---|---|---|---|---|---|---|---|---|---|
| | | Sample Size | | | | | | | |
| ° C. | | 5.5 g | 5.5 g | 5.5 g | 5.5 g | 5.5 g | 5.5 g | 5.5 g | 5.5 g |
| 425 | Extraction time. Hours | 90 | | 44.0 | 60.0 | 44.4 | | | |
| | Nil extraction (%) | 67% | | 74% | 79% | 86% | | | |
| | Fe extraction (%) | 54% | | 52% | 38% | 35% | | | |
| 500 | Extraction Time. Hours | 14.0 | 60.0 | 24.0 | 44.0 | 42.0 | 44.0 | 44.0 | 44.0 |
| | Nil extraction (%) | 31% | 45% | 42% | 65% | 79% | 61% | 71% | 61% |
| | Fe extraction (%) | 29% | 38% | 31% | 36% | 29% | 30% | 23% | 18% |
| 550 | Extraction Time. Hours | | | | | | | 44.0 | |
| | Nil extraction (%) | | | | | | | 62% | |
| | Fe extraction (%) | | | | | | | 19% | |

*Sulphiding at 100° C. and atmospheric pressure

All other sulphiding at 50° C. and 15 psi pressure

TABLE 9

TGA Tests: Carbonylation (Atm., 50° C.) of Rduced Matte Calcine (Sample "F" with 2% Fe); Effect of varying reducing atmosphere and reduction temperature, and of varying sulphide activation levels (1% S to 6% S) at 50° C.

| Reduction temperature, ° C. | | Sulphiding level Sulfur level | | | | | | | | | |
|---|---|---|---|---|---|---|---|---|---|---|---|
| | | 1.0% | 2.0% | 4.0% | 4.5% | 6.0% | 3.0% wt. S Reduction atm 10% $H_2O$-90% $H_2$ | 3.0% wt. S Reduction atm 20% $H_2O$-80% $H_2$ | 3.0% wt. S Reduction atm 30% $H_2O$-70% $H_2$ | 4.5% wt. S Reduction atm 30% $H_2O$-70% $H_2$ | 4.5 wt. % elemental sulfur Reduction atm 100% $H_2$ |
| | | Reduction atm 100% $H_2$ | | | | | | | | | |
| | | Sample size | | | | | | | | | |
| | | 5 g | 5 g | 5 g | 5 g | 5 g | 5 g | 5 g | 5 g | 5 g | 5 g |
| 425 | Extraction time, Hours | | 44 | | 44 | 68 | | | | 44 | 24[+] |
| | Nil extraction (%) | | 74% | | 88% | 77% | | | | 88% | 49% |
| | Fe extraction (%) | | 21% | | 21% | 8% | | | | 15% | 1% |
| 500 | Extraction time, Hours | | | 44 | 44 | 44 | 44 | 44 | 44 | 44 | |
| | Ni extraction (%) | | | 82% | 84% | 74% | 65% | 60% | 79% | 75% | |
| | Fe extraction (%) | | | 14% | 5% | 12% | 2.6% | 0.8% | ND | ND | |

[+]Reaction was "dead" after 24 hours.
ND—Not detectable

TABLE 10

TGA Tests: Carbonylation (Atm., 50° C.) of Reduced Matte Calcine (Sample "F" with 2% Fe); Reduction effected with higher oxygen potential gas (30% $H_2O$ in hydrogen) at 500° C., Effect of varying sulphide activation levels (2% S to 4.5% S) and temperatures (30° C. to 150° C.)

| Reduction Temp. ° C. | | Sulfiding Temp. with $H_2S$ gas | | | | | | | | |
|---|---|---|---|---|---|---|---|---|---|---|
| | | 50° C. | 70° C. | 100° C. | 120° C. | 135° C. | 150° C. | 300° C. | 30-70° | 50° C. |
| | | Sulfiding Pressure (PSI) | | | | | | | | |
| | | atmospheric | atmospheric | atmospheric | atmospheric | atmospheric | atmospheric | atmospheric | atmospheric | 15 |
| | | Sulfur level | | | | | | | | |
| | | 2.0% | 3.0% | 3.0% | 3.0% | 3.0% | 3.0% | 3.0% | 3.0% | 4.5% |
| 500 | Extraction time, Hours | 44 | 44 | 44 | 44 | 44 | 44 | 44 | 44 | 44 |
| | Ni extraction (%) | 69% | 72% | 79% | 79% | 70% | 51% | 32% | 71% | 75% |
| | Fe extraction (%) | 13% | 6% | ND | ND | ND | ND | 11% | ND | ND |

[+]Reactor was heated up between 30-70° C. and sulfiding was done during the temperature rise
ND—Not detectable

Example 8

Tests Related to the Processing of an Intermediate Nickel-Cobalt Hydroxide Material Produced by Acid Leaching of a Limonitic Laterite Ore A series of TGA tests was carried out to establish optimum processing conditions for the extraction and recovery of refined nickel from an intermediate nickel-cobalt material, "G" in Table 1. Reduction temperature, degree of sulphiding with $H_2S$ gas, pressures and times employed for carbonylation were varied while pure hydrogen was employed for reduction and temperature for carbonylation was maintained at 30-85° C. The results are summarized in Table 11 and depicted in FIGS. 6 and 7. It is demonstrated that nickel hydroxide intermediate with 32 w/w % of nickel and 4.5 w/w % of cobalt yields some 50% or less of its nickel to the formation of nickel carbonyl at atmospheric reaction pressure and with no sulphur activation, even after extended carbonylation reaction times. However, increasing the reaction pressure moderately to 700 kPa, even with no sulphur activation, results in nickel extraction of some 90% in as little as 8 hours.

Pre-sulphiding with $H_2S$ at the lower temperature of 50° C., provided a high nickel extraction of 78% in 7 hours at a pressure of only 100 kPa, in Test G11, described in Table 11, and depicted in FIG. 7.

In other tests, G26 and G30, the nickel extractions at 100 kPa reached as high as 74% in 42 hours.

Additional tests were carried out on larger laboratory samples of 20 grams, employing a packed bed reactor for the reduction, for the low temperature sulphiding with $H_2S$ and for the carbonylation, wherein the carbonylation temperature was either 50° C. or 30° C. and carbonylation pressure was at 100 kPa or under. As seen in test GT-3, a high extraction of nickel was achieved at a carbonylation pressure of 100 kPa and nickel was preferentially carbonylated in comparison with the cobalt, thereby raising the Ni:Co ratio from 7.2:1 in the feed to over 700:1 in the nickel product plated after decomposition. Carbonylation at 70 kPa in test GT-4 yielded nickel extraction of 59% in 40 hours, and the nickel to cobalt ratio was increased to 1700:1 in the product. These extraction results are decidedly better than those achieved in the TGA tests, no doubt due to the better gas-solids contact.

Although this disclosure has described and illustrated certain preferred embodiments of the invention, it is to be understood that the invention is not restricted to those particular embodiments. Rather, the invention includes all embodiments which are functional or mechanical equivalence of the specific embodiments and features that have been described and illustrated.

The invention claimed is:

1. A method of producing an activated metallic nickel from a solid metallic nickel for subsequent reaction with carbon monoxide, said method comprising treating said solid metallic nickel with hydrogen sulphide at a pressure selected from 100 to 300 kPa and a temperature selected from 20 -150° C. for an effective activation period of time to produce said activated metallic nickel.

2. A method as claimed in claim 1 wherein said solid metallic nickel is at least 95% pure.

3. A method as claimed in claim 2 wherein said solid metallic nickel is at least 99% pure.

4. A method as claimed in claim 1 wherein said solid metallic nickel is in admixture with one or more metals selected from cobalt, copper and iron, and treating said admixture with said hydrogen sulphide to effect production of one or more sulphides selected from copper sulphide, cobalt sulphide and iron sulphide.

5. A method as claimed in claim 4 wherein said admixture is a metallic product comprising oxides of nickel, cobalt, copper and iron.

TABLE 11

TGA Tests: Reduction, Sulphiding and Carbonylation of Nickel-Cobalt Hydroxide; Material "G"

| | | | | Sulphiding | | | | Carbonylation | | | | |
|---|---|---|---|---|---|---|---|---|---|---|---|---|
| | | | | | | | | | | | Extraction | |
| Sample ID | Sample size, g | Reduc. Temp. ° C. | Reduc. Time, Hours | H2S Over Pressure PSI | Temp. ° C. | Time, Hrs. | % S added to metal | Pressure PSI | Temp. ° C. | Time, Hrs. | % Nickel | % Co |
| G1 | 3.30 | 300 | 40 | — | — | — | 0.00 | 150 | 30 | 22 | 84 | 10 |
| G2 | 3.30 | 350 | 5 | — | — | — | 0.00 | 150 | 30 | 18 | 82 | 34 |
| G3 | 3.30 | 400 | 2 | — | — | — | 0.00 | 0 | 50 | 63 | 50 | 23 |
| G4 | 3.30 | 400 | 2 | — | — | — | 0.00 | 15 | 30 | 15 | 54 | 2 |
| G5 | 3.30 | 400 | 2 | — | — | — | 0.00 | 100 | 30 | 12 | 84 | 49 |
| G6 | 3.30 | 400 | 2 | — | — | — | 0.00 | 100 | 50 | 50 | 87 | 35 |
| G7 | 3.30 | 400 | 2 | — | — | — | 0.00 | 150 | 30 | 8 | 88 | 24 |
| G8 | 3.30 | 400 | 2 | — | — | — | 0.00 | 150 | 50 | 8 | 84 | 24 |
| G9 | 3.30 | 400 | 2 | — | — | — | 0.00 | 150 | 85 | 18 | 82 | 34 |
| G10 | 3.30 | 400 | 2 | 15 | 50 | 0.20 | 0.60 | 100 | 50 | 20 | 84 | 23 |
| G11 | 3.30 | 400 | 2 | 15 | 50 | 0.55 | 2.00 | 15 | 50 | 7 | 79 | 18 |
| G12 | 3.30 | 400 | 2 | 15 | 50 | 1.05 | 7.00 | 15 | 50 | 7 | 41 | 20 |
| G25 | 3.30 | 400 | 2.00 | — | — | — | 0.00 | 15 | 50 | 22 | 23 | 7 |
| G26 | 3.30 | 400 | 2.00 | 15 | 50 | 0.50 | 2.00 | 15 | 50 | 42 | 74 | 21 |
| G27 | 3.30 | 400 | 2.00 | 15 | 50 | 0.55 | 2.00 | 15 | 50 | 22 | 64 | 16 |
| G28** | 3.30 | 400 | 2.00 | 15 | 50 | 0.30 | 1.50+ | 15 | 50 | 22 | 50 | 13 |
| G29* | 3.30 | 400 | 2.00 | 15 | 50 | 0.20 | 1.00+ | 15 | 50 | 22 | 39 | 7 |
| G30 | 3.30 | 400 | 2.00 | 15 | 50 | 1.40 | 3.00 | 15 | 50 | 22 | 61 | 9 |

Mini-Pilot Plant Test: Reduction, Sulphiding and Carbonylation of Nickel-Cobalt Hydroxide; Material "G"

| | | | | Sulphiding | | | | Carbonylation | | | | | | | |
|---|---|---|---|---|---|---|---|---|---|---|---|---|---|---|---|
| | | | | | | | | | | | Extraction | | Product analysis | | |
| Sample ID | Sample size, g | Reduc. Temp. ° C. | Reduc. Time, Hours | H2S Over Pressure PSI | Temp. ° C. | Time, Hrs. | % S added to metal, Calcl' | Pressure PSI | Temp. ° C. | Time, Hrs. | % Nickel | % Co | % Nickel | % Co | % S |
| GT-1 | 20.00 | 450 | 5 | — | — | — | 0.00 | 150 | 50 | 48 | 88 | — | 72.0 | 0.1 | — |
| GT-2 | 20.00 | 450 | 5 | — | — | — | 0.00 | 100 | 30 | 8 | 90 | — | 70.0 | 0.1 | — |
| GT-3+ | 19.80 | 400 | 6 | 15 | 50 | 7 | | 15 | 50 | 26 | 82 | 7 | 74.5 | 0.1 | |
| GT-4+ | | 400 | 6 | 15 | 50 | 7 | | 10 | 50 | 26 | | | | | |

*Sulphur level increased by addition of H2S gas in CO, 0.02% H2S - Balance CO, during carbonylation

**Sulphur level increased by addition of H2S gas in CO, 8% H2S - Balance CO, during carbonylation +Carbonylation for first 2 hours with 100% CO, then switch to 99% CO –1% H2S for another 20 hours because of slow reaction.

6. A method as claimed in claim 1 wherein said temperature is selected from 100-120° C. and said pressure is selected from 100 to 200 kPa.

7. A method according to claim 1, wherein said solid metallic nickel is in the form of a powder.

8. A method according to claim 1, wherein said solid metallic nickel is a nickel matte emanated from a smelt.

* * * * *

US007776129C1

(12) EX PARTE REEXAMINATION CERTIFICATE (9799th)

United States Patent

Curlook et al.

(10) Number: US 7,776,129 C1

(45) Certificate Issued: Aug. 15, 2013

(54) APPARATUS AND PROCESS FOR MAKING HIGH PURITY NICKEL

(75) Inventors: Walter Curlook, Toronto (CA); Dmitri Terekhov, Newmarket (CA); Sergiy Kovtun, Missisauga (CA); Olujide Babatunde Olurin, Richmond Hill (CA); Nanthakumar Victor Emmanuel, Toronto (CA)

(73) Assignee: CVMR Corporation, Toronto, ON (CA)

Reexamination Request:
No. 90/012,298, Jun. 25, 2012

Reexamination Certificate for:

| | |
|---|---|
| Patent No.: | **7,776,129** |
| Issued: | **Aug. 17, 2010** |
| Appl. No.: | **11/790,171** |
| Filed: | **Apr. 24, 2007** |

(51) Int. Cl.
*C22B 9/14* (2006.01)

(52) U.S. Cl.
USPC ..... 75/343; 148/675; 423/561.1

(58) Field of Classification Search
None
See application file for complete search history.

(56) References Cited

To view the complete listing of prior art documents cited during the proceeding for Reexamination Control Number 90/012,298, please refer to the USPTO's public Patent Application Information Retrieval (PAIR) system under the Display References tab.

*Primary Examiner* — Sean E Vincent

(57) ABSTRACT

An improved method of reducing a mixed metal oxide composition comprising oxides of nickel, cobalt, copper and iron in a hydrogen atmosphere to produce a mixture of the respective metals, the improvement wherein the atmosphere further comprises water vapour at a concentration, temperature and time to effect selective reduction of the oxides of nickel cobalt and copper relative to the iron oxide to produce the metallic mixture having a reduced ratio of metallic iron relative to metallic nickel, cobalt and copper.

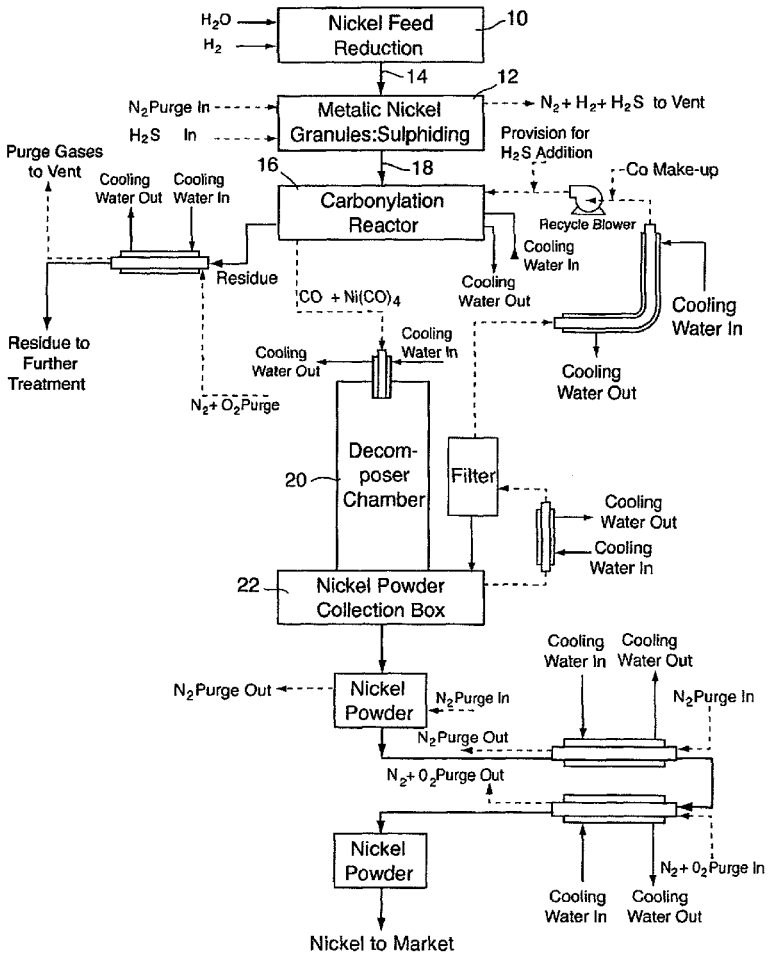

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-8 are cancelled.

* * * * *